United States Patent [19]

Burch

[11] 4,090,166

[45] May 16, 1978

[54] SWITCH STRUCTURE AND CALIBRATION TECHNIQUE

[75] Inventor: Lyndon W. Burch, Boston, Mass.

[73] Assignee: B/K Patent Development, Inc., Highland Park, Ill.

[21] Appl. No.: 722,106

[22] Filed: Sep. 10, 1976

[51] Int. Cl.[2] ..... H01H 37/20

[52] U.S. Cl. ..... 337/360; 29/622; 200/249; 337/299; 337/374

[58] Field of Search ..... 337/360, 374, 354, 299, 337/82, 323, 392; 29/622; 200/249

[56] References Cited

U.S. PATENT DOCUMENTS

| | | | |
|---|---|---|---|
| 2,427,944 | 9/1947 | Clark | 337/354 |
| 2,715,168 | 8/1955 | Mertler | 337/354 |
| 2,824,933 | 2/1958 | Shanley | 337/354 |
| 2,831,090 | 4/1958 | Kueser | 337/374 |
| 2,851,559 | 9/1958 | Rosen | 337/354 |

FOREIGN PATENT DOCUMENTS

| | | | |
|---|---|---|---|
| 365,000 | 1/1932 | United Kingdom | 337/354 |

*Primary Examiner*—Harold Broome
*Attorney, Agent, or Firm*—Kenway & Jenney

[57] ABSTRACT

Disclosed are a switch structure and a calibration technique that facilitate the rapid and substantially automatic calibration of a switch of the type that responds to changes in an environmental parameter (e.g., a thermostatic switch). An abutment member (which will serve as the calibrated stop) is supported for preliminary movement with a switch movable member (e.g., a bimetallic arm) and is supported in a bracket which is capable of gripping the abutment member but which is initially prevented from doing so by the action of a member that stresses the bracket. The last-mentioned member is deformable (e.g., it melts) at a desired value of the environmental parameter, thereby resulting in the bracket gripping the abutment member (which then defines a stop for the switch's movable member).

14 Claims, 5 Drawing Figures

SWITCH STRUCTURE AND CALIBRATION TECHNIQUE

BACKGROUND OF THE INVENTION

The present invention relates to an improved switch structure and to a technique for calibrating or "zeroing" the switch during manufacture. The switch is of the type that responds to changes in an environmental parameter (e.g., temperature). The most common variety of such a switch, of course, is a thermostatic switch incorporating a bimetallic member that moves in response to temperature changes to open and/or close the switch contacts. Such switches typically include a stop member disposed to abut the bimetallic arm at a predetermined orientation of that arm, thereby determining the temperature at which contact is made, or broken, by movement of the bimetallic arm.

In the manufacture of such switches, the positioning of such a stop member has traditionally been accomplished by a time-consuming, and expensive, manual setting of a mechanical adjustment. An additional difficulty with this prior calibration technique is that it is dependent upon the skill and/or attentiveness of the worker, thereby rendering suspect the uniformity of calibration between switches calibrated by different workers.

In view of the above discussion, it is a principal object of the present invention to provide an improved switch structure, and a technique of switch calibration, which eliminates the need for manual calibration of such switches. It is an additional object to provide such a switch, and such a technique, which are conducive to improved uniformity of calibration, improved speed of manufacture, and reduced expense of manufacture.

SUMMARY OF THE INVENTION

Briefly, in one aspect the invention features a method of calibrating a switch that includes a movable contact-making and contact-breaking member that moves relative to a base in response to a first environmental parameter and for which an abutment member is desired at a position of the movable member corresponding to a particular value of that first environmental parameter. The method includes the steps of providing an abutment member disposed to engage the movable member as it moves; providing gripping means for gripping the abutment member; interposing second means that are disposed to inhibit the gripping action of said gripping means and that are deformable at a particular value of a second environmental parameter; and then exposing the second means to the above-mentioned particular value of the second environmental parameter while simultaneously exposing the movable member to its particular value of its environmental parameter. Preferably, the environmental parameters are each temperature and the particular values for the movable member and the second means are identical.

In another aspect of the invention, improvements are provided in a switch that includes the movable contact-making and contact-breaking member that moves in response to a first environmental parameter with respect to a fixed contact. In such a switch there is provided an assembly for providing an abutment member for that movable member. That assembly comprises an abutment member disposed to engage the movable member; a bracket for the abutment member having an opening in which said abutment member is received, the opening having an unstressed size and shape that causes the bracket to grip the abutment member; and stressing means that stress the opening to a size and shape permitting the abutment member to move with respect to the bracket and that are deformable at a particular value of an environmental parameter. With such an arrangement, the abutment member is permitted to be moved to a predetermined location with respect to the path of motion of the movable member and then gripped by the bracket upon exposure of the stressing means to the particular value of an environmental parameter.

BRIEF DESCRIPTION OF THE DRAWING

Other objects, features, and advantages of the invention will appear from the description below of a preferred embodiment, taken together with the accompanying drawing, in which.

DETAILED DESCRIPTION OF A PARTICULAR PREFERRED EMBODIMENT

Figure 1:
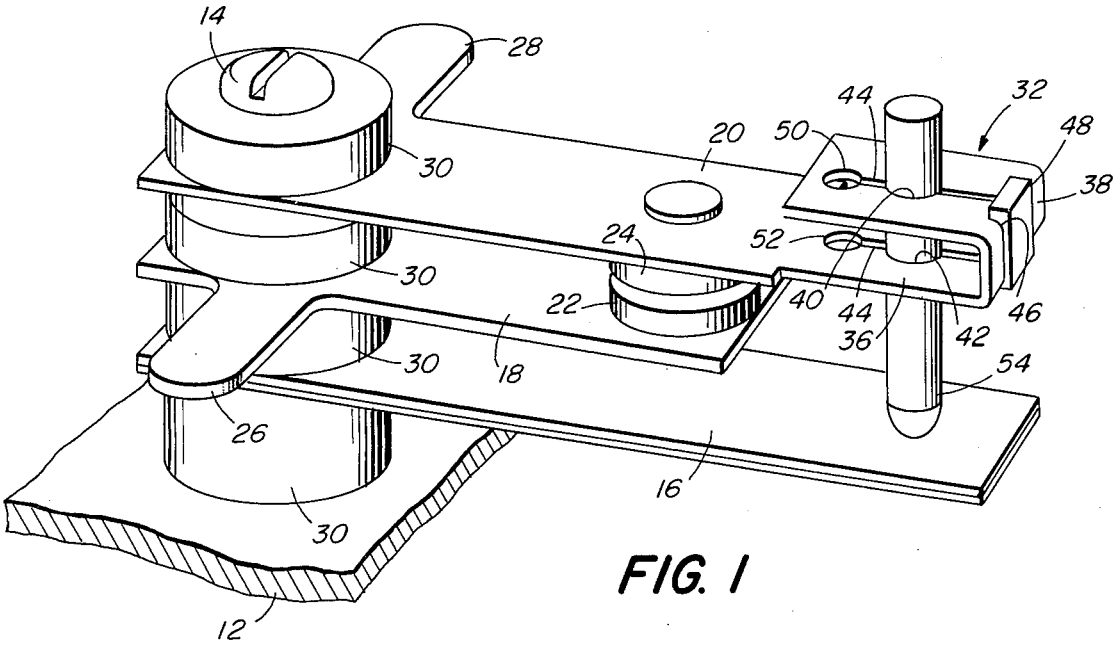
FIG. 1 is a perspective view of a switch incorporating features according to the present invention.

Referring to FIG. 1, there is shown a thermostatic switch 10 mounted upon a base 12 by means of a screw 14. The switch includes a bimetallic arm 16 (e.g., 0.015 inch TRUFLEX), a fixed contact arm 18 (e.g., 0.010 inch beryllium copper), and a movable contact arm 20 (e.g., 0.008 inch beryllium cooper). Conventional contact members 22, 24 are supported in a conventional manner on the arms 18 and 20. Arms 18 and 20 also include laterally projecting tabs 26, 28 for receiving connectors attached to lead wires (not shown). The arms 16, 18 and 20 are arranged in a stack and are separated from each other, and from the base 12, by insulators (e.g., ceramic washers) 30.

The movable contact arm 20 is longer than the fixed contact arm 18 and includes a projecting bracket 32 which overlies, and is aligned with, an end portion of the similarly longer bimetallic arm 16. The bracket 32 is generally U-shaped, including upper and lower legs 34 and 36 and an integral end leg 38. The bracket 32 includes a complexly shaped opening that includes aligned circular apertures 40 and 42 in the upper and lower legs 34 and 36, respectively, and a slot 44 communicating with those apertures. The slot 44 includes a widened portion 46 in the leg 38 that receives a wedge 48 of solid material and enlarged ends 50 and 52 at the ends of the slot remote from the leg 38. An electrically insulating (e.g., ceramic) abutment 54 is received in the apertures 40 and 42 and is disposed to abut the upper surface of an end portion of the bimetallic arm 16.

The wedge of material 48 is chosen to have a size and shape such that, when it is inserted into the portion 46 of slot 44, the bracket 32 is stressed to slightly enlarge the apertures 40 and 42, thereby permitting free sliding movement of the member 54 therein. The wedge of material 48 is also chosen to be deformable at a particular value of an environmental parameter so that exposure of the wedge 48 to that value of that parameter will permit the stressed bracket 32 to assume a configuration in which the member 54 is firmly gripped by the upper and lower bracket legs 34 and 36.

Figure 2:
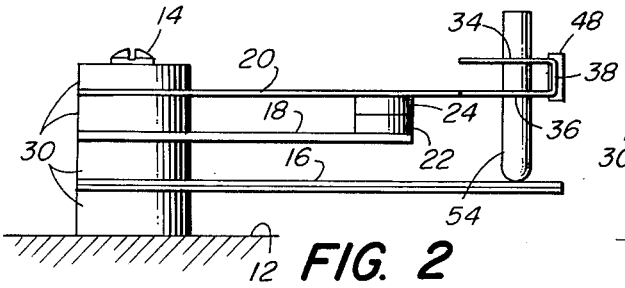
FIGS. 2–5 are side elevation views of the switch of FIG. 1 illustrating steps in the sequence of calibration and use of the switch.
Figure 3:
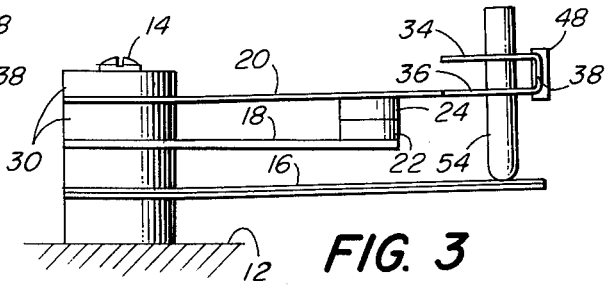
Figure 4:
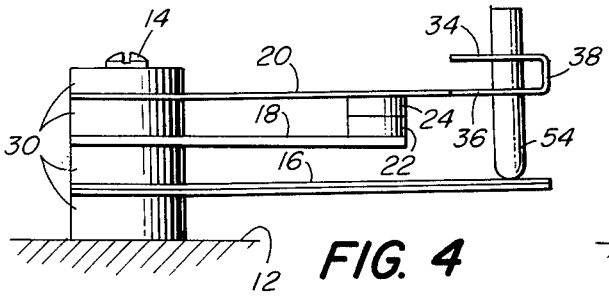
Figure 5:
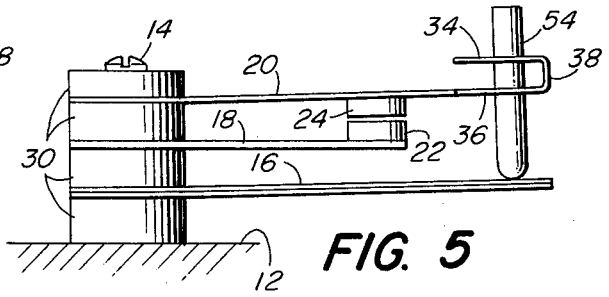

In one particularly desirable arrangement, the wedge of material 48 is chosen to have a melting temperature the same as the temperature at which the thermostatic switch is to be actuated. With this arrangement, the switch, as assembled to the condition shown in FIG. 1, would have a room-temperature configuration as shown in FIG. 2. Raising the temperature of the bimetallic strip 16 (e.g., placing the entire switch in a controlled oven) to a point just below the melting temperature of the wedge of material 48 results in the member 54 being pushed upwardly relative to the bracket 32 by the arm 16 (see FIG. 3). The subsequent slight additional raising of the temperature past the melting point of the wedge 48 results in that wedge melting and the consequent gripping of the member 54 by the bracket 32 (see FIG. 4), thereby positioning the abutment member 54 properly for switch actuation at the desired temperature. After this calibration procedure, the switch can be employed in a temperature-varying environment in which engagement of contacts 22, 24 will be broken (see FIG. 5) by upward force transmitted to arm 20 through member 54 and bracket 32 when a temperature above the calibration temperature causes the bimetallic arm 16 to move past the calibration or "zero" setting that is defined at the melting point of the wedge 48.

As will be understood by those skilled in the art from the above discussion, to achieve the substantially automatic and convenient calibration according to the present invention it is required that the member 54 be slidable relative to bracket 32 in order to remain in contact with the bimetallic arm 16 prior to the melting of wedge 48. Although in the illustrated embodiment the force of gravity provides for continuous contact between the member 54 and the arm 16, it should be understood that in other switch embodiments other forces could be employed (e.g., a weak spring, magnetic attraction, etc.).

Furthermore, if it is necessary, or desirable, to calibrate the switch to a temperature which does not correspond to the precise temperature of a conveniently available material for the wedge 48, suitable calibration can be accomplished by simply exposing the bimetallic arm 16 to the desired temperature and then selectively exposing the wedge of material 48 to its melting temperature. This arrangement is particularly convenient where the calibration temperature is lower than the melting temperature of the wedge 48. With such circumstances, the entire switch 10 can be placed in an over at the calibration temperature and then further heat applied specifically to the wedge 48 by any convenient means (e.g., a focused hot air blast, laser beam, etc.).

Furthermore, such a specific application of heat to the wedge 48 may be desirable for the calibration of a switch responding to some environmental factor other than temperature. For Example, if the bimetallic arm 16 were replaced by a pressure sensitive diaphragm, the device could be calibrated by placing it in a chamber at the calibration pressure and then melting the wedge 48 by applying heat specifically to the wedge 48. It should also be understood that the important criterion for the wedge 48 is that it be rigid at values other than a critical value of the particular environmental parameter and that it become deformable at the critical value. Thus, for a temperature sensitive wedge of material 48, it may not be necessary that the material go suddenly liquid at the critical temperature, but only that it soften to the degree necessary to permit the relaxation of the stress in the bracket 32.

The wedge could, of course, respond to atmospheric parameters other than temperature. For example, the wedge could go into solution in an atmosphere saturated with a particular solvent, could collapse when exposed to a sufficient high pressure, etc.

For some switches and some environments of usage, the gripping force of the bracket 32 on the member 54 after calibration has been completed may not be sufficient to ensure that the member 54 will not move relative to the bracket during the lifetime of the switch. In such circumstances, of course, means to supplement the gripping of the bracket 32 could be employed (e.g., soldering, cementing, etc.).

While a particular preferred embodiment of the present invention has been illustrated in the accompanying drawing and described in detail herein, other embodiments are within the scope of the invention and the following claims.

What is claimed is:

1. The method of providing an engagement member for a movable first member at a particular position of said first member comprising the steps of providing an abutment member disposed to engage said first member as said first member moves, providing gripping means for gripping said abutment member, providing second means that are disposed to inhibit the gripping action of said gripping means and that are permanently deformable at a particular value of an environmental parameter, and exposing said second means to said particular value of said environmental parameter when said first member is at said particular position.

2. The method of calibrating a switch that includes a movable contact-making and contact-breaking member that moves relative to a base in response to a first environmental parameter and for which an abutment member is desired at the member's position corresponding to a particular value of said first parameter, comprising the steps of providing an abutment member disposed to engage said movable member as it moves, providing gripping means for gripping said abutment member, interposing second means that are disposed to inhibit the gripping action of said gripping means and that are permanently deformable at a particular value of a second environmental parameter, and then exposing said second means to said particular value of said second environmental parameter while exposing said movable member to said particular value of said first environmental parameter.

3. The method of claim 2 wherein said second environmental parameter is the same parameter of said first environmental parameter.

4. The method of claim 3 wherein said environmental parameter is temperature.

5. The method of claim 4 wherein said particular value of temperature for said movable member is the same as said particular value of temperature of said second means.

6. The method of claim 5 wherein said steps of exposing said second means to said particular value of temperature and exposing said first member to said particular value of temperature comprise the steps of placing said switch in an oven maintained at a temperature below said particular value of temperature and then raising the temperature in said oven to a value at least equal to said particular value of temperature.

7. The method of claim 2 further including the additional final step of soldering said abutment member to said gripping means.

8. The method of claim 2 further including the additional final step of cementing said abutment member to said gripping means.

9. In a switch including a movable contact-making and contact-breaking member that moves with respect to a fixed contact in response to a first environmental parameter, the improvement comprising an assembly for providing an abutment member for said movable member, said assembly comprising an abutment member disposed to engage said movable contact-making and contact-breaking member, a bracket for said abutment member having an opening in which said abutment member is received, said opening having an unstressed size and shape that causes said bracket to grip an abutment member received in said opening, and stressing means that stress said opening to a size and shape permitting movement of said abutment member with respect to said bracket and that are deformable at a particular value of an environmental parameter;

thereby enabling said abutment member to be moved to a predetermined location and then gripped by said bracket upon exposure of said stressing means to said particular value of said environmental factor.

10. In a switch as claimed in claim 9, the further improvement wherein said bracket opening comprises an aperture for receiving said abutment member and a slot communicating with said aperture, said stressing means being inserted into a portion of said slot.

11. In a switch as claimed in claim 10, the further improvement wherein said bracket includes first and second segments, each segment having an aperture, the apertures being coaxial, said stressing means stressing each said aperture to a size and shape permitting movement of said abutment member with respect to said bracket.

12. In a switch as claimed in claim 11, the further improvement wherein said bracket is a U-shaped unitary member, said first and second segments comprising parallel legs of said U-shape.

13. In a switch as claimed in claim 12, the further improvement wherein said slot communicates with each of said apertures and includes an enlarged portion at the location of the third leg of said U-shape, said stressing means being received in said enlarged slot portion.

14. In a switch as claimed in claim 9, the further improvement wherein said stressing means comprises a pellet of a material, said particular value of an environmental parameter at which said pellet is deformable being the melting temperature of said material.

* * * * *